US007650668B2

(12) United States Patent
Kim

(10) Patent No.: US 7,650,668 B2
(45) Date of Patent: Jan. 26, 2010

(54) UPRIGHT VACUUM CLEANER

(75) Inventor: Kyung Chul Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 672 days.

(21) Appl. No.: 11/100,534

(22) Filed: Apr. 7, 2005

(65) Prior Publication Data

US 2006/0021183 A1 Feb. 2, 2006

(30) Foreign Application Priority Data

Jul. 27, 2004 (KR) ..... 10-2004-0058526

(51) Int. Cl.
*A47L 5/00* (2006.01)

(52) U.S. Cl. ..... 15/323; 15/351; 15/410

(58) Field of Classification Search ..... 15/323, 15/351, 410; *A47L 5/00*
See application file for complete search history.

(56) References Cited

U.S. PATENT DOCUMENTS

| | | | | |
|---|---|---|---|---|
| 4,467,493 | A * | 8/1984 | Buchtel | 15/323 |
| 4,761,850 | A * | 8/1988 | Romeo et al. | 15/323 |
| 5,233,722 | A * | 8/1993 | McKnight et al. | 15/323 |
| 5,247,719 | A * | 9/1993 | Wareham et al. | 15/323 |
| 6,374,452 | B1 * | 4/2002 | Essex et al. | 15/323 |
| 7,350,261 | B2 * | 4/2008 | Lee et al. | 15/323 |

* cited by examiner

*Primary Examiner*—David A Redding
(74) *Attorney, Agent, or Firm*—KED & Associates, LLP

(57) ABSTRACT

An upright vacuum cleaner is provided. Thanks to a mini nozzle seat formed by subsiding in a front side on an upper portion of the vacuum cleaner, a mini nozzle can be received in a stable and solid manner when the mini nozzle is not in use, whereby convenience in use can be enhanced.

21 Claims, 6 Drawing Sheets

UPRIGHT VACUUM CLEANER

BACKGROUND OF THE INVENTION

1. Field of the Invention

The present invention relates to an upright vacuum cleaner, and more particularly, to an upright vacuum cleaner having a mini nozzle seat for safely receiving a mini nozzle in a main body of the upright vacuum cleaner when the mini nozzle for use in cleaning a corner is not used. Further, the present invention relates to an upright vacuum cleaner capable of reducing possibility of being lost or detached of a mini nozzle by, when the mini nozzle is used, having the mini nozzle connected with a hose and used and, when it is not used, having the mini nozzle received in and fixed to the main body of the upright vacuum cleaner.

2. Description of the Related Art

A vacuum cleaner is generally classified into a canister vacuum cleaner and an upright vacuum cleaner. Particularly, the upright vacuum cleaner includes a main body, a nozzle unit and a handle that are integrally formed, so the vacuum cleaner itself is moved when a user pushes or pulls a handle by gripping it. At this time, dusts on the floor are sucked through the nozzle to clean the floor. A general configuration of such an upright vacuum cleaner is already well known in many documents, so it is not described here in detail.

In the meantime, the upright vacuum cleaner has a limitation in cleaning the whole indoor space due to its own shape. In more detail, since the upright vacuum cleaner has the main body, the main nozzle unit and the handle integrated and the whole vacuum cleaner moves at the same time during the cleaning operation, it has many restrictions in view of space to be cleaned. For example, the main nozzle of the upright vacuum cleaner cannot reach a corner or an edge of such as a stairway, whereby the corner or edge cannot be cleaned. In order to solve this problem, there had been proposed an upright vacuum cleaner in which only a hose may be separated from the sucking nozzle body and then a mini nozzle is connected to an end of the separated hose. That is to say, with the main body of the upright vacuum cleaner being placed at its original position, the mini nozzle is connected to the end of the sucking hose and a user cleans corners and edges by moving only the mini nozzle.

In the meantime, the mini nozzle has a small size. Thus, there exists a high possibility of being lost. In spite of such possibility, the mini nozzle has been stored in a separate apparatus box for cleaning that is separated from the vacuum cleaner and taken out and used whenever necessary.

SUMMARY OF THE INVENTION

Accordingly, the present invention is directed to an upright vacuum cleaner that substantially obviates one or more problems due to limitations and disadvantages of the related art.

An object of the present invention is to provide an upright vacuum cleaner capable of safely receiving a mini nozzle in an inside of a reception part by forming a predetermined reception part on a body of the vacuum cleaner.

Another object of the present invention is to provide an upright vacuum cleaner capable of having a mini nozzle safely received and taken out and used conveniently anytime, anywhere when a user desires, starting from an idea that there exists in the vacuum cleaner a predetermined space that can be utilized.

Further another object of the present invention is to provide an upright vacuum cleaner capable of receiving a mini nozzle in a more safe manner by having the once received mini nozzle not detached unless more than predetermined external force is applied.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an upright vacuum cleaner, which includes: a sucking nozzle unit for sucking an outer air; a vacuum cleaner body in which a dust collecting unit for separating foreign particles from air sucked through the sucking nozzle unit, is located; a connection tube for connecting the vacuum cleanser body with the sucking nozzle unit; a mini nozzle selectively connected to the vacuum cleaner body; a mini nozzle seat formed by subsiding in an upper portion of the vacuum cleaner body, for fixing the mini nozzle; and a lower hanging part formed on a lower surface of the mini nozzle seat, for preventing the mini nozzle from being detached after inserted.

In another aspect of the present invention, there is provided an upright vacuum cleaner, which includes: a sucking nozzle unit for sucking an air; a vacuum cleaner body into which a dust collecting unit is received, for filtering foreign particles from the sucked air; a mini nozzle selectively fixed to the vacuum cleaner body and constituting an appearance of the vacuum cleaner body; a mini nozzle seat formed by subsiding in an upper front portion of the vacuum cleaner body, for fixing the mini nozzle; and hanging parts formed at least on more than two locations of an inner surface in the mini nozzle seat, for preventing the mini nozzle from being detached after the mini nozzle is inserted.

In further another aspect of the present invention, there is provided a mini nozzle reception structure of an upright vacuum cleaner, which includes: a mini nozzle selectively used depending on a use state of the upright vacuum cleaner; a mini nozzle seat formed by subsiding in an upper portion of the vacuum cleaner body, for fixing the mini nozzle; and at least more than one hanging parts formed on an inner surface of the mini nozzle seat, for preventing the mini nozzle from being detached after the mini nozzle is seated.

According to the present invention, the mini nozzle can be used in a more convenient manner.

Further, the mini nozzle can be taken out from the upright vacuum cleaner body and used anytime whenever the mini nozzle is necessary during cleaning work, whereby user convenience can be enhanced even more. Still further, while seated, the mini nozzle is not detached even by strong external impulse, whereby a possibility of being lost is reduced.

Also, since the mini nozzle itself constitutes an appearance of the upright vacuum cleaner, the vacuum cleaner becomes more elegant in its appearance.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. However, the spirit of the invention is not limited to the embodiments, but those skilled in the art might easily propose other embodiments by adding, changing, deleting or modifying components within the scope of the invention.

Figure 1:
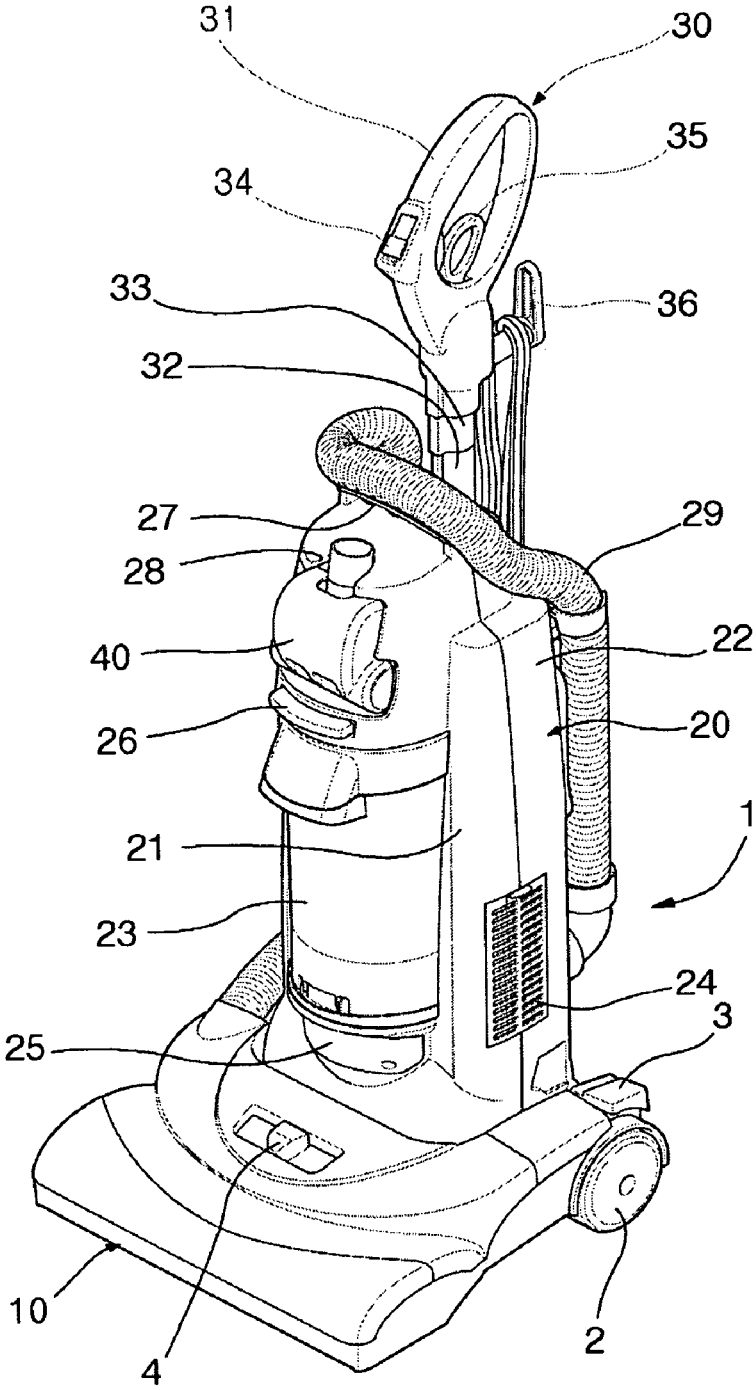
FIG. 1 is a front perspective view showing an upright vacuum cleaner according to the present invention.
Figure 2:
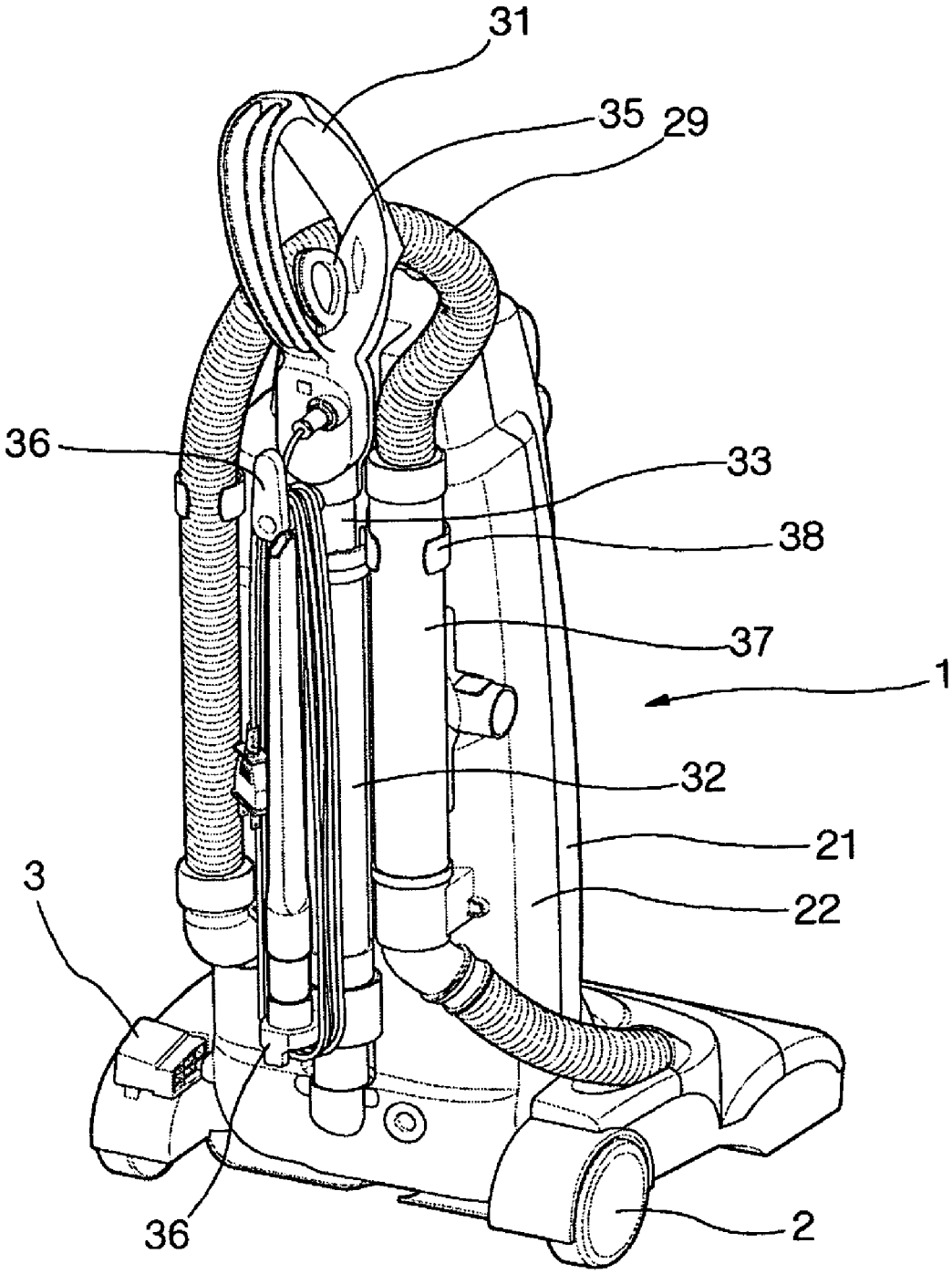
FIG. 2 is a rear perspective view showing the upright vacuum cleaner according to the present invention.

FIG. 1 is a front perspective view illustrating an upright vacuum cleaner according to the present invention, and FIG. 2 is a rear perspective view illustrating the upright vacuum cleaner of the present invention.

Referring to FIGS. 1 and 2, the upright vacuum cleaner 1 of the present invention includes, in brief: a sucking nozzle unit 10 contacted with the floor, for sucking an outer air; a body 20 for mounting main parts such as a sucking motor and a fan thereto, and a manipulation handle 30 formed on an upper portion of the vacuum cleaner so that the vacuum cleaner may be moved in an easy way during the cleaning work. The cleaning work using the vacuum cleaner is conducted as follows. First, an air is sucked through the sucking nozzle unit 10 together with foreign particles. The sucked air is cleaned by means of a cyclone manner or a filtering manner in the body 20 with separating foreign particles therefrom, and then discharged via a predetermined discharge hole. In addition, in order to move the vacuum cleaner to a desired position, a user grips the manipulation handle 30 of the vacuum cleaner and then pulls or pushes the vacuum cleaner.

More specifically, the sucking nozzle unit 10 is used for sucking an outer air and has a substantially rectangular shape with a certain portion open toward the floor. The sucking nozzle unit 10 is hinged to the body 20, and a pivoting lever 3 controls this hinge movement. In addition, for better movement, the sucking nozzle unit 10 further includes wheels 2 mounted at a rear portion of the sucking nozzle unit 10, and a height control knob 4 mounted on an upper surface of the sucking nozzle unit 10 for height control of the sucking nozzle unit 10. The air sucked into the sucking nozzle unit 10 is guided to the body 10 by means of a hose 29. For this purpose, both ends of the hose 29 are respectively connected to the sucking nozzle unit 10 and the body 20, and the hose 29 has so sufficient length as to wind an upper portion of the vacuum cleaner one time so that the hose 29 may be moved to a long distance conveniently.

More specifically, the body 20 includes a front case 21 for protecting a front portion of the body and a rear case 22 for protecting a rear portion of the body, and the cases 21 and 22 are combined each other by a predetermined manner such as fitting or screwing. Furthermore, the body 20 is provided with a dust collecting unit 23 for collecting dusts from the air sucked through the hose 29, a detachable lever 26 for separating the dust collecting unit 23 from the body 20 in a convenient way, a discharge cover 24 formed in a side of the body, for allowing the air free from foreign particles to be discharged, a lamp 25 for giving a light to the floor at night so that the vacuum cleaner may be manipulated in a convenient way, a mini nozzle seat 28 formed by subsiding in an upper end of the front case 21, and a mini nozzle 40 selectively received in the mini nozzle seat 28. The mini nozzle 40 may be used for cleaning places that cannot be directly reached by the main body of the upright cleaner like a corner and received in the mini nozzle seat 28 during a custody time. The mini nozzle 40 is an example of sucking nozzles through which an air is sucked, detail construction of which will be described later. Here, the mini nozzle seat 28 has the same shape and size in its appearance as the mini nozzle 40 so that the mini nozzle 40 may be exactly seated in an inside of the mini nozzle seat 28 and has predetermined fixing parts for preventing the once seated mini nozzle 40 from being detached.

In addition, the body 20 is also provided with, on its rear side, a code hook 36 protruded at upper and lower positions of the body 20 so that a power line is wound and kept in custody thereon, a hose guide 37 that configures at least a part of the hose 29 and is made of solid materials unlike the hose 29, and a holder 38 protruded on the rear side of the body 20 so as to support the hose guide 37. The hose guide 37 is used for convenient positioning of the mini nozzle 40 when the mini nozzle is used in connection to the hose 29.

In the meantime, to the hose guide 27, other sucking nozzle unit such as the mini nozzle 40 may be conveniently connected. For this purpose, one end of the hose guide 37 connected to the hose 29 is easily separated, and then other sucking nozzle unit such as the mini nozzle 40 may be connected thereto. In addition, the hose 29 has a bellows shape, so its length may be shortened while being kept in custody and elongated over five times depending on cases when being used by a user. Thus, the hose 29 enables a user to clean a place far away from the main body of the vacuum cleaner.

In addition, at an upper end of the front case 21, the hose 29 may be seated in a shrunk state, and a carrying handle 27 is formed for a user to grip and carry the vacuum cleaner. The carrying handle 27 may be used not only for holding and carrying the vacuum cleaner but also for holding the hose 29.

More specifically, the manipulation handle 30 includes a handle grip 31 for a user to grip the vacuum cleaner conveniently while the vacuum is operating, and an operation switch 34 formed at a predetermined position of the handle grip 31 and used for controlling operation of the vacuum cleaner itself such as initiation of the vacuum cleaner and sucking force of the vacuum cleaner. In addition, a length of the manipulation handle 30 may be conveniently adjusted. More specifically, for adjustment of the length, the manipulation handle 30 includes an extension pipe 33 extended below the handle grip 31, and a fixed pipe 32 that supports the extension pipe 33 and allows the extension pipe 33 to be moved through it by means of selective manipulation of an extension lever 35 so that the length of the manipulation handle 30 may be shortened or elongated.

Among the components of the vacuum cleaner, the present invention mainly has an interest on the mini nozzle 40 and a structure for receiving the mini nozzle 40, particularly on a structure and a method for fixing and seating the upright vacuum cleaner 1.

Figure 3:
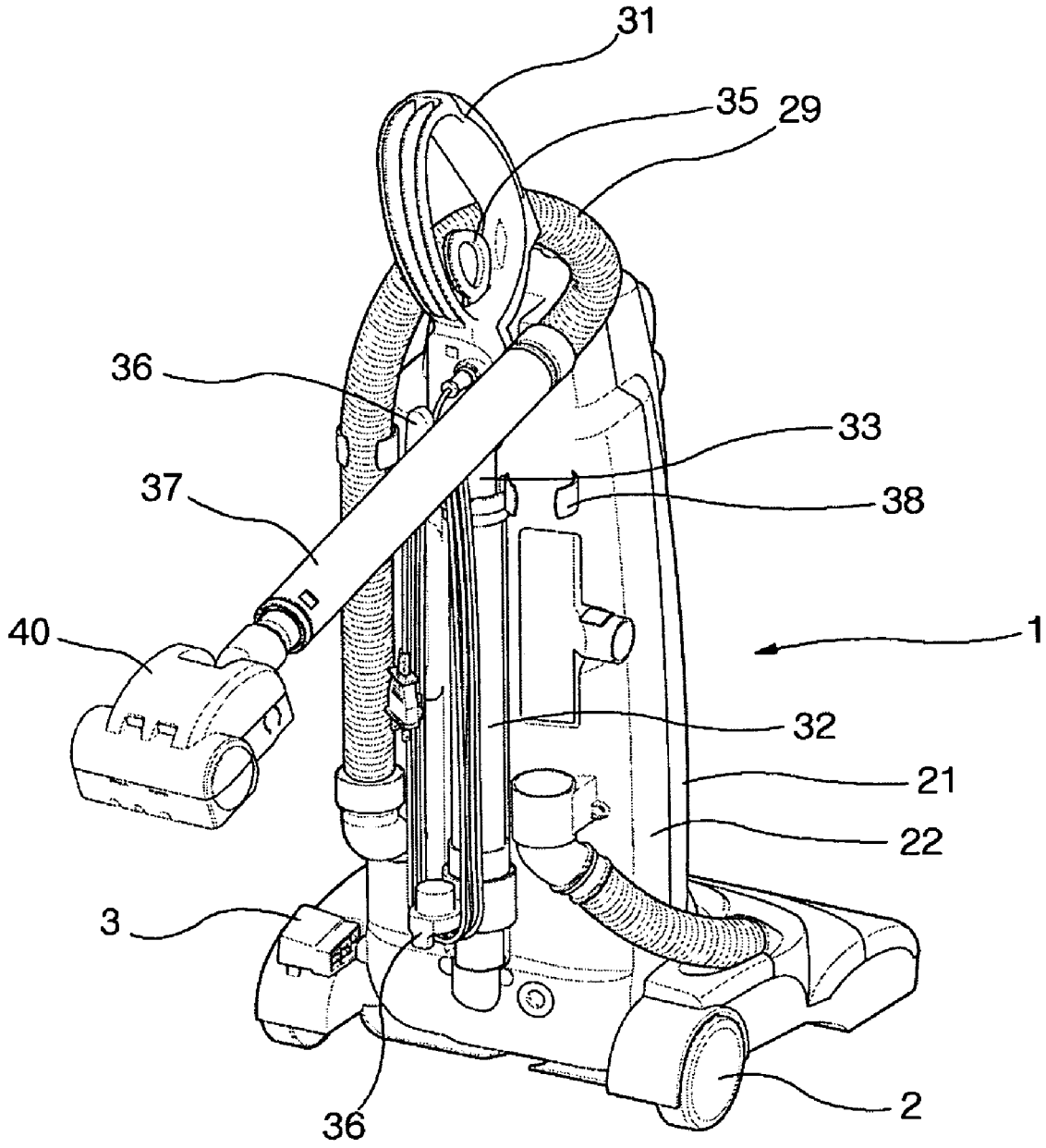
FIG. 3 is a perspective view showing a used state of the upright vacuum cleaner.

FIG. 3 is a perspective view for illustrating a used state of the mini nozzle.

Referring to FIG. 3, the mini nozzle 40 is separated from the mini nozzle seat 28 and then connected to the hose guide 37. Thus, with the body 20 of the vacuum cleaner being fixed, a user may clean a room with moving just the hose 29 and the hose guide 37. That is to say, the body 20 of the vacuum cleaner 1 and the sucking nozzle unit 10 operate to suck an air with their positions fixed, and the mini nozzle 40 may perform cleaning by moving the hose 29. At this time, a user may grip the hose guide 37 to move the mini nozzle 40. In particular, the mini nozzle 40 has a small size, so it may be conveniently used for cleaning a place such as a corner or a stairway that is not easily reached by the vacuum cleaner.

Figure 4:
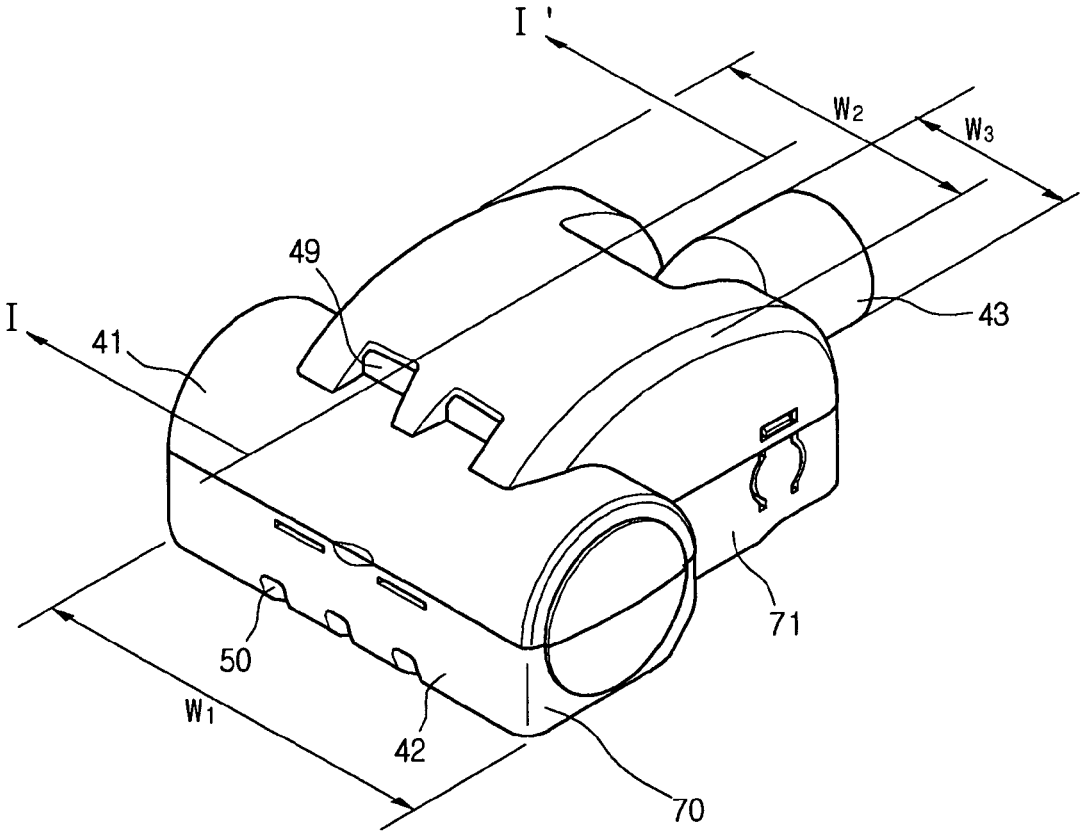
FIG. 4 is a perspective view showing a mini nozzle adopted in the upright vacuum cleaner according to the present invention.
Figure 5:
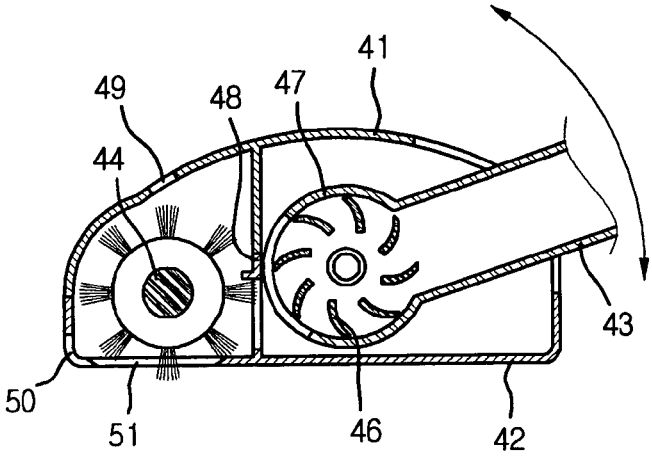
FIG. 5 is a cross-sectional view taken along line I-I' of FIG. 4.

FIG. 4 is a perspective view showing a mini nozzle according to the present invention, and FIG. 5 is a cross-sectional view taken along line I-I' of FIG. 4.

Referring to FIGS. 4 and 5, the mini nozzle 40 according to the spirit of the present invention includes an upper cover 41 for protecting an upper portion of the mini nozzle 40, a lower cover 42 for protecting a lower portion of the mini nozzle 40, and a sucking tube 43 for sucking an air discharged from the mini nozzle 40 into the hose guide 37. In addition, the mini nozzle 40 includes, in its inner place, an agitator 44 mounted at a front portion of the mini nozzle 40, for floating dusts on the floor to improve cleaning efficiency, a turbine housing 47 mounted to an inner end of and formed integrally with the sucking tube 43, a turbine 46 placed in the turbine housing 47 and rotated by the air flowing in the turbine housing 47, and a belt (not shown) for connecting rotational axes of the turbine 46 and the agitator 44. Moreover, an air guide 48 for separating the inner space of the mini nozzle 40 into an agitator receiving space and a turbine receiving space is formed so that airflow is guided toward the turbine more easily. In addition, the sucking tube 43 is formed integrally with the turbine housing 47 and possibly pivoted on the rotational axis of the turbine housing 47. Thus, a user may move the mini nozzle 40 conveniently. In FIG. 5, an arrow illustrates a rotational direction of the sucking tube 43.

In addition, a sucking hole 51 for sucking air on the floor is formed in a lower surface of the lower cover 42. A bypass channel is also formed so that air is bypassed and sucked when the sucking hole 51 is blocked by flexible members such as a carpet. More specifically, the bypass channel includes a first bypass channel 50 formed at a lower edge of a front surface of the lower cover 42, and a second bypass channel 49 formed in an upper surface of the upper cover 41. Thanks to the bypass channels 49 and 50, air is bypassed and sucked into the mini nozzle 40, whereby overheating of a motor in the body of the vacuum cleaner can be prevented.

In the meantime, examination of the whole shape of the mini nozzle 40 shows that a left-right width of the mini nozzle 40 changes in three steps on the whole. That is to say, the width changes into a front part 70 whose width W1 is widest, the sucking tube 43 whose width W3 is narrowest, and a rear part 71 whose width W2 is narrower than that of the front part 70 and wider than that of the sucking tube 43. The change in the width of the mini nozzle 40 is intended for widening the sucking hole 51 formed in a lower side of the front part 70 so that an air may be sucked over a more wide range.

Referring to FIGS. 4 and 5, operation and function of the mini nozzle according to the spirit of the present invention will be described. If negative pressure is generated in the sucking tube 43 by operation of the vacuum cleaner, air is strongly sucked through the sucking hole 51. Of course, the sucking tube 43 is connected with the body 20 of the vacuum cleaner by means of the hose guide 37 and the hose 29, so that negative pressure may be generated in relation to a sucking fan (not shown) in the body 20. In addition, together with the air sucked through the sucking hole, foreign particles on the floor are rapidly sucked toward the turbine 46. The rapid airflow rotates the turbine 46, and is then sucked into the main body of the vacuum cleaner via the sucking tube 43. In addition, since the rotational axis of the turbine 46 is connected with the rotational axis of the agitator 44 by the belt (not shown), the agitator 44 is simultaneously rotated when the turbine 46 is rotated. If the agitator 44 is rotated, dusts on the floor are floated, whereby the cleaning efficiency is improved.

When the sucking hole 51 is blocked by a member such as a carpet, air is bypassed and sucked into the sucking nozzle 40 through the first and/or second bypass channel 50 and/or 49, so that the sucking motor (not shown) mounted in the vacuum cleaner may not be overheated.

Figure 6:
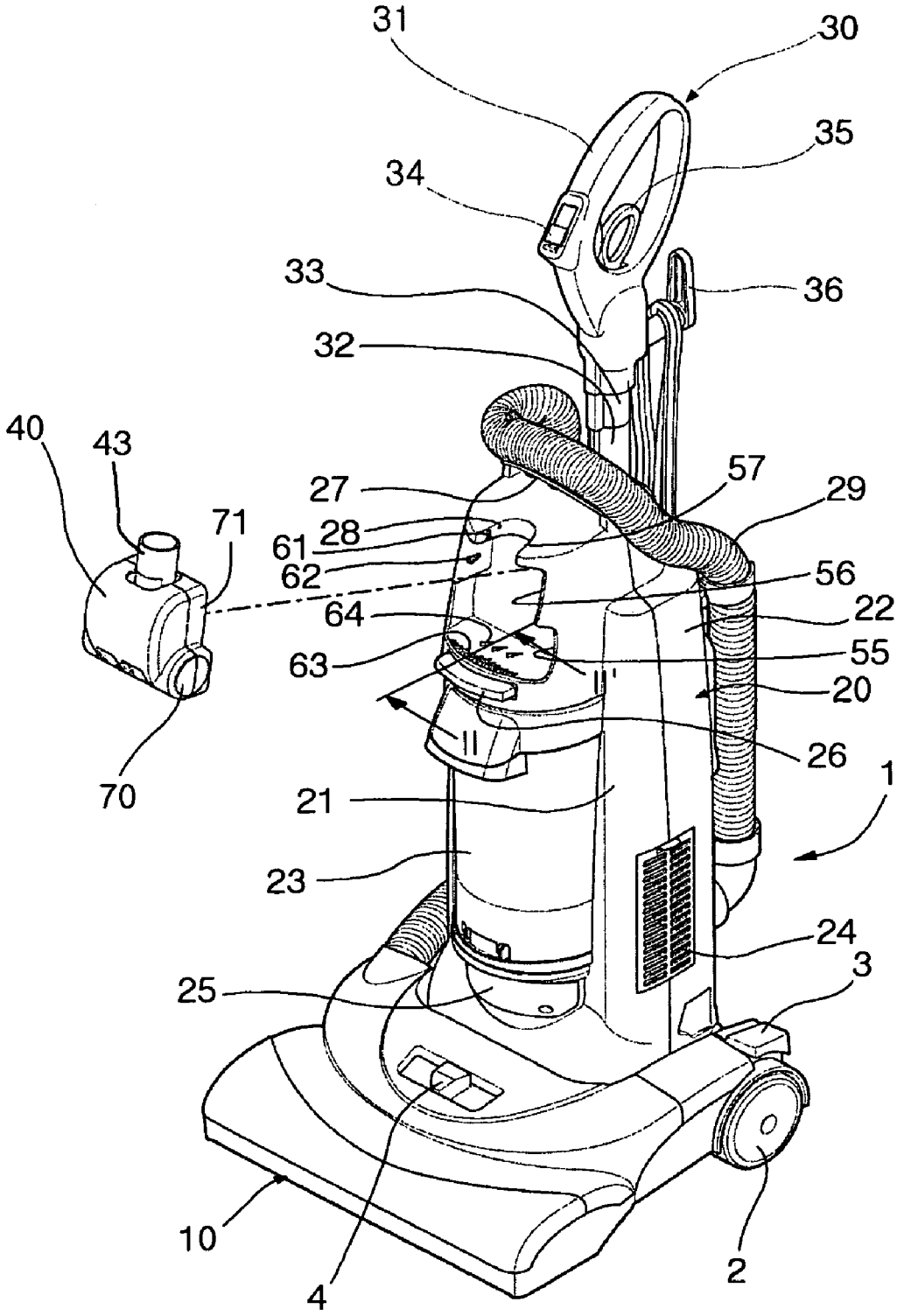
FIG. 6 is a view illustrating a state where a mini nozzle is separated from an upright vacuum cleaner of the present invention.

FIG. 6 is a view illustrating a state where the mini nozzle is separated from the upright vacuum cleaner of the present invention. A construction of the mini nozzle seat 28 will be described with reference to FIG. 6 in detail in the following.

The mini nozzle seat 28 is similar, in its shape, to the mini nozzle on the whole and the mini nozzle 40 is mounted on the vacuum cleaner so that its front part 70 faces downward. More specifically, the mini nozzle seat 28 includes a front seat 55 on which the front part 70 is seated, a rear seat 56 oh which the rear part 71 is seated, and a sucking tube seat 57 on which the sucking tube 43 is seated. Each of the seats 55, 56, and 57 becomes narrow gradually in its width so that the mini nozzle 40 may be exactly seated. In other words, similarly with the mini nozzle 40, the front seat 55 is widest in its width, the rear seat 56 is narrower in its width than the front seat 55, and the sucking tube seat 57 is narrowest in its width. For maximization of space utilization in the vacuum cleaner, the sucking tube seat 57 is open upward and the sucking tube 43 of the mini nozzle 40 is protruded to an upward direction of the sucking tube seat 57. Thanks to the shape of the sucking tube seat 57, an installation space of the mini nozzle 40 may be formed in a more narrow way.

In addition, forming the mini nozzle seat 28 on the upper portion of the vacuum cleaner is intended for a user to attach/detach the mini nozzle 40 conveniently, and further, since the upper portion in which the dust collecting unit 23 is placed is generally vacant in its inside, the mini nozzle 40 can be easily seated without increasing a size of the upright vacuum cleaner itself.

In the meantime, after seated in an inside of the mini nozzle seat 28, the mini nozzle 40 should be firmly fixed in the inside of the mini nozzle seat 28 without being detached by an external impulse. For that purpose, more than three lower hanging jaws 64 protruded from a lower side of the front seat 55 are formed, and at least more than one side hanging jaws 62 are formed on sides of the rear seat 56. The side hanging jaws 62 may be also formed on inner sides of the front seat 55. In addition, an insertion guide 63 which is inclined as it goes backward is formed on a front edge of a lower side of the front seat 55 so that an exact position of the mini nozzle 40 may be guided when the mini nozzle 40 is inserted into the inside of the mini nozzle seat 28. In addition, at least more than one sucking tube hanging jaws 61 are formed on an inner side of the sucking tube seat 57 so that a fixing position of the sucking tube 43 may be exactly indicated.

The hanging jaws 64, 62, and 61 are smoothly bent, so that each member seated or detached may slide over the hanging jaws smoothly and a user may manipulate the members swiftly. Particularly, the lower hanging jaws 64 are spaced on their three places so that scratches may not be generated over a wide area of the front part in the mini nozzle 40. In addition, subsiding grooves or holes may be formed on a main body of the mini nozzle 40 corresponding to the hanging jaws 64, 62, and 61, so that the mini nozzle 40 may be more firmly fixed in its position in cooperation with the hanging jaws 64, 62, and 61.

Figure 7:
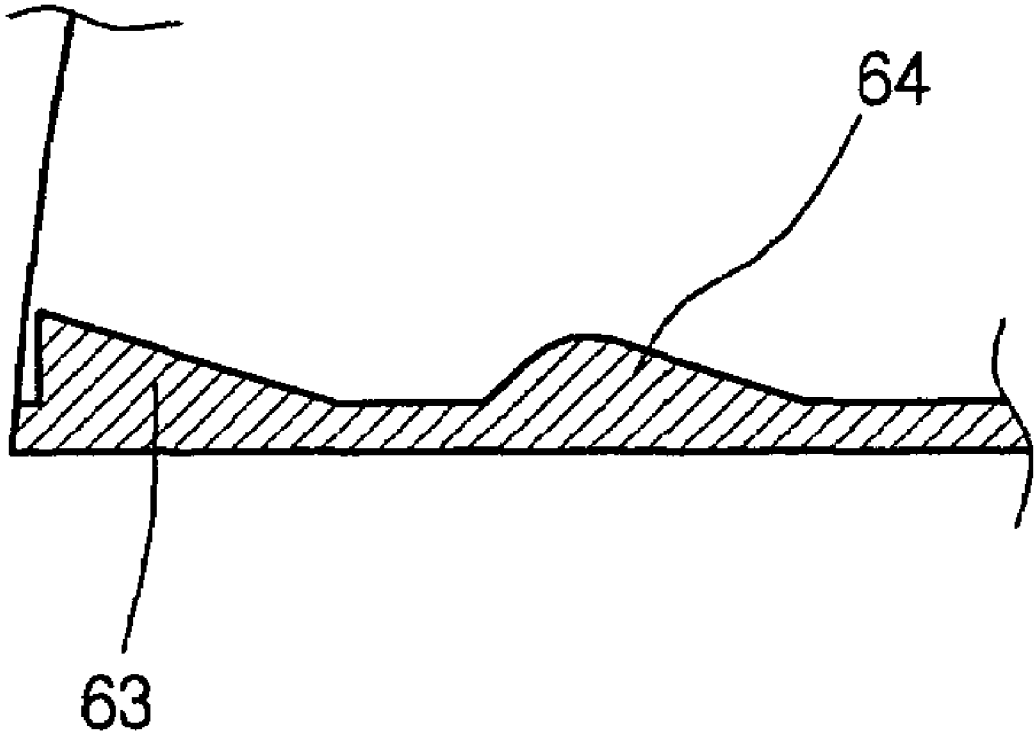
FIG. 7 is a cross-sectional view taken along line II-II' of FIG. 6.

FIG. 7 is a cross-sectional view taken along line II-II' of FIG. 6. Referring to FIG. 7, the insertion guide 63 is inclined toward a lower side as it goes backward from a lower front edge of the mini nozzle seat 28, so that the inserted mini nozzle 40 may smoothly slide over the insertion guide 63. The lower hanging jaws 64 are smoothly protruded upward so that the front part of the mini nozzle 40 may be swiftly inserted.

An insertion operation of the mini nozzle 40 will be sequentially described with reference to FIGS. 6 and 7 in the following. After the front part 70 of the mini nozzle 40 is positioned to face downward, the front part 70 slides over the insertion guide 63 and is inserted into the inside of the mini nozzle seat 28. After inserted in a predetermined depth, the front part 70 of mini nozzle 40 slides over the lower hanging jaws 64 and is inserted more deeply into the inside of the mini nozzle seat 28. At this point, the rear end of the rear part 71 in the mini nozzle 40 may slide over the side hanging jaws 62 and be inserted into an upper end of the rear seat 56 or be detached. If the rear part 71 of the mini nozzle 40 remains not inserted with the front part 70 inserted, a user may push the rear part 71 into an inside over the side hanging jaws 62.

After the front part 70 and the rear part 71 of the mini nozzle 40 are inserted into the inside of the mini nozzle seat 28 through the above-described process, the sucking tube 43 is inserted. Since the sucking tube 43 is possibly rotated with respect to the main body of mini nozzle 40, the sucking tube 43 is protruded to the outside even in a state that the front part 70 and the rear part 71 are inserted in the inside of the mini nozzle seat 28. Thus, finally the sucking tube 43 is pushed into the inside of the sucking tube seat 57. In addition, if pushed backward, the sucking tube 43 can be received in the inside of the sucking tube seat 57 by operation of the sucking tube 43 sliding over the sucking hanging jaws 61. Since an appearance itself of the mini nozzle 40 constitutes an appearance of the vacuum cleaner in a state that the mini nozzle 40 is received in the inside of the mini nozzle seat 28, the appearance of the vacuum cleaner itself becomes elegant.

As described above, if the mini nozzle 40 is received in the inside of the mini nozzle seat 28, the front end of the front part in the mini nozzle 40 is placed on a lower side of the mini nozzle seat 28 and a weight of the mini nozzle 40 can be supported. Since the front part of the mini nozzle 40 once inserted is supported by the lower hanging jaws 64, side portions of the mini nozzle 40 are supported by the side hanging jaws 62, and an upper portion of the mini nozzle 40 is supported by the hanging jaw between the rear seat 56 and the sucking tube seat 57, the mini nozzle 40 is not detached even when an impulse is applied from the outside. In addition, since the sucking tube 43 is supported by the sucking tube hanging jaws 61, the sucking tube 43 is not moved and can remain fixed in its position in the inside of the sucking tube seat 57.

If a user desires to take out the mini nozzle 40, the mini nozzle 40 can be taken out conveniently by user's operations of griping and taking out the front part 70 of the mini nozzle 40, which provides a user convenience.

The same function and effect as describe above can also be obtained by conversely forming the jaws 64, 62, and 61 on the main body of the mini nozzle 40 and the grooves on the mini nozzle seat 28. In that case, the appearance of the mini nozzle 40 is complicated and an injection process is difficult, which are thus not desirable. However, the sprit of the present invention does not exclude this case.

The spirit of the present invention has one feature in mounting conveniently the mini nozzle in the main body of the vacuum cleaner so that the position of the mini nozzle is fixed and firmly supported against an impulse from the outside.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An upright vacuum cleaner, comprising:

a suction nozzle that draws in external air;

a vacuum cleaner body that receives a dust collecting device that separates foreign particles from the air drawn in by the suction nozzle;

a connection tube that connects the vacuum cleaner body with the suction nozzle;

a tube guide having one end thereof that is detachably connected to the connection tube;

a mini nozzle configured to be coupled to the vacuum cleaner body in a first mode and to the one end of the tube guide in a second mode, wherein the mini nozzle includes a suction hole through which air is drawn into the mini nozzle and a suction tube that is rotatably installed within the mini nozzle so as to discharge air from the suction hole into the tube guide coupled thereto in the second mode;

a mini nozzle seat formed as a recess in one face of the vacuum cleaner body so as to couple the mini nozzle to the vacuum cleaner body in the first mode, the mini nozzle seat having a shape corresponding to a shape of the mini nozzle, wherein the mini nozzle seat comprises a suction tube seat having suction tube hanging jaws that protrude from an inner surface thereof so as to rotatably couple the suction tube within the mini nozzle; and a lower hanging part formed on a lower surface of the mini nozzle seat, wherein the lower hanging part secures the mini nozzle in the mini nozzle seat.

2. The vacuum cleaner according to claim 1, wherein the lower hanging part comprises a lower jaw that protrudes from a lower surface of the mini nozzle seat.

3. The vacuum cleaner according to claim 1, wherein an upper end of the mini nozzle seat is open.

4. The vacuum cleaner according to claim 1, wherein the mini nozzle seat is formed by a plurality of seating portions having a corresponding plurality of widths so as to divide the mini nozzle seat into three steps vertically.

5. The vacuum cleaner according to claim 1, wherein the mini nozzle seat further comprises:

an insertion guide that guides an insertion operation of the mini nozzle into the mini nozzle seat, wherein the insertion guide is formed at an incline from a front edge of a lower surface of the mini nozzle seat towards a rear of the mini nozzle seat.

6. The vacuum cleaner according to claim 1, wherein the mini nozzle seat further comprises a plurality of lower hanging parts formed spaced apart from each other on a lower surface of the mini nozzle seat.

7. The vacuum cleaner according to claim 1, wherein the mini nozzle seat further comprises:

side hanging parts formed on inner side surfaces of the mini nozzle seat so as to support corresponding side surfaces of the mini nozzle inserted in the mini nozzle seat.

8. The vacuum cleaner according to claim 1, wherein the mini nozzle seat comprises a rear seat having hanging jaws that protrude from an inner surface thereof so as to support a rear part of the mini nozzle inserted therein.

9. The vacuum cleaner according to claim 1, wherein the mini nozzle seat comprises:

a front seat having a first width, wherein the front seat receives a front part of the mini nozzle; and a rear seat having a second width that is less than the first width, wherein the rear seat receives a rear part of the mini nozzle, wherein the suction tube seat has a third width that is less than the second width.

10. The vacuum cleaner according to claim 1, wherein the mini nozzle seat comprises a plurality of seating portions having a corresponding plurality of widths such that steps between adjacent seating portions perform a function of a hanging jaw.

11. The vacuum cleaner according to claim 1, wherein the mini nozzle seat is formed on an upper portion of the vacuum cleaner body adjacent to the dust collecting device.

12. An upright vacuum cleaner, comprising:

a suction nozzle that draws in air;

a vacuum cleaner body that receives a dust collecting device that filters foreign particles from the air drawn in by the suction nozzle;

a hose that connects the vacuum cleaner body with the suction nozzle;

a hose guide detachably coupled to an end of the hose, a mini nozzle configured to be coupled to the vacuum cleaner body in a first mode and to a free end of the hose guide in a second mode, wherein the mini nozzle includes a suction hole through which air is drawn into the mini nozzle and a suction tube that discharges the air from the suction hole into the hose guide;

a mini nozzle seat formed as a recess in the vacuum cleaner body so as to receive the mini nozzle therein, the mini nozzle seat having a shape corresponding to a shape of the mini nozzle; and hanging parts formed on more than two locations of an inner surface of the mini nozzle seat, wherein the hanging parts secure the mini nozzle in the mini nozzle seat, the hanging parts including suction tube hanging jaws that protrude from the inner surface of the mini nozzle seat for supporting the suction tube.

13. The vacuum cleaner according to claim 12, wherein the hanging parts are formed on a lower surface and at least one side surface of the mini nozzle seat.

14. The vacuum cleaner according to claim 12, wherein the hanging parts comprise protrusion-type hanging jaws.

15. The vacuum cleaner according to claim 12, wherein a width of the mini nozzle seat is stepped so as to be divided into three steps.

16. The vacuum cleaner according to claim 12, wherein an upper portion of the mini nozzle seat is open so that a corresponding portion of the mini nozzle protrudes to an outside of the mini nozzle seat.

17. An upright vacuum cleaner, comprising:

a main body;

a mini nozzle configured to be operably coupled to the vacuum cleaner based on a use state of the vacuum cleaner;

a mini nozzle seat formed as a recess in the main body so as to receive the mini nozzle therein, the mini nozzle seat having a contour that corresponds to the mini nozzle; and a plurality of hanging parts formed on an inner surface of the mini nozzle seat, wherein the plurality of hanging parts secure the mini nozzle in the mini nozzle seat, wherein each of the plurality of hanging parts comprises:

a plurality of first hanging jaws that protrude from a bottom inner surface toward a central portion of the mini nozzle seat;

at least one second hanging jaw that protrudes from at least one of two opposite inner lateral side surfaces toward the central portion of the mini nozzle seat; and at least one third hanging jaw that protrudes from an upper inner surface toward the central portion of the mini nozzle seat.

18. The vacuum cleaner of claim 17, wherein the mini nozzle comprises:

a front portion including an agitator that draws particle laden air into the mini nozzle;

a rear portion coupled to the front portion, wherein the rear portion receives particle laden air from the front portion; and a sucking tube portion coupled to the rear portion, wherein the sucking tube portion includes a sucking tube that directs particle laden air from the mini nozzle to the main body of the vacuum cleaner.

19. The vacuum cleaner of claim 18, wherein the plurality of first hanging jaws removably couple the front portion of the mini nozzle to the bottom inner surface of the mini nozzle seat, the at least one second hanging jaw removably couples the rear portion of the mini nozzle to the at least one of the two opposite inner lateral side surfaces of the mini nozzle seat, and the at least one third hanging jaw removably couples the sucking tube portion of the mini nozzle to the upper inner surface of the mini nozzle seat.

20. The vacuum cleaner of claim 17, wherein the contour of the mini nozzle seat matches the contour of the mini nozzle along an entire periphery of the mini nozzle.

21. The vacuum cleaner of claim 17, wherein an exposed outer surface of the mini nozzle is flush with an outer surface of the main body when the mini nozzle is received in the mini nozzle seat.

* * * * *